United States Patent [19]

Farrell

[11] Patent Number: 4,466,269

[45] Date of Patent: Aug. 21, 1984

[54] CONVOLUTED TUBE BENDING TOOL

[75] Inventor: Robert Farrell, Wilmette, Ill.

[73] Assignee: Everco Industries Inc., Lincolwood, Ill.

[21] Appl. No.: 424,066

[22] Filed: Sep. 27, 1982

[51] Int. Cl.[3] ..... B21J 13/08

[52] U.S. Cl. ..... 72/459

[58] Field of Search ..... 72/459, 457, 458

[56] References Cited

U.S. PATENT DOCUMENTS 871,052 11/1907 Wallace ..... 72/459

1,752,220 3/1930 Allen ..... 72/457

2,464,002 3/1949 Snyder ..... 72/458

2,804,791 9/1957 Wheeler ..... 72/459

3,472,056 10/1969 Gregg ..... 72/389

*Primary Examiner*—Daniel C. Crane

*Assistant Examiner*—David B. Jones

[57] ABSTRACT

A hand operated bending tool for bending convoluted tubes, pipes, and other tubular material, with the tool providing a tool handle socket and a flexible tube gripping band that, upon initial movement of the tool, will grip and secure the free end of the tube to the bending shoe of the tool.

7 Claims, 5 Drawing Figures

CONVOLUTED TUBE BENDING TOOL

SUMMARY OF THE INVENTION

This invention relates generally to a hand operated bending tool, and, more particularly, to a bending tool for convoluted tubes and pipes.

It is an object of the present invention to provide a tube bending tool which is hand operated, and which includes an arcuated bending shoe against which a tube is bent to form a bend in the tube; a handle receiving socket attached to the arcuated bending shoe which, through the use of a handle inserted therein, will rock the tool on a supporting surface effecting a bending of the tube; a tube gripping and securing band mounted on the handle socket and adapted to receive and accommodate tubes of various diameters and radii for securing the same to the arcuated bending shoe.

As it is the principal object of this invention to provide a hand bending tool for convoluted tubes and the like, the arcuated bending shoe provides a track way which is formed to provide a series of convolution receiving grooves whereby the convolutions of the tube will not be collapsed or compressed during the bending operation.

Other objects, features and advantages of this invention will be apparent from the foregoing detailed description.

BRIEF DESCRIPTION OF THE DRAWINGS

The invention will be best understood by reference to the accompanying drawings which show the mode of construction by which the stated objects of the invention are achieved, and in which.

DETAILED DESCRIPTION

Figure 1:
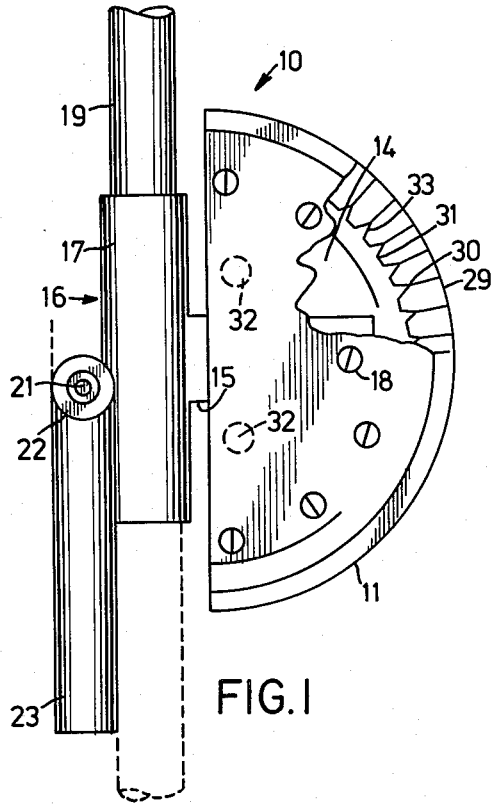
FIG. 1 is a fragmentary side elevational view of the bending tool of this invention.
Figure 2:
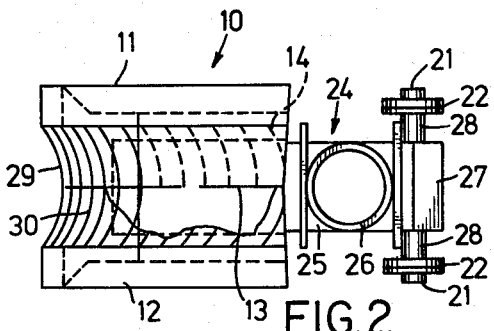
FIG. 2 is a fragmentary end view of the bending tool.

Referring now to the drawings, and, in particular to FIG. 1, the numeral 10 generally designates the convoluted tube hand bender tool made in accordance with the principles of the present invention. The hand bender tool 10 is preferably formed from a high strength material, and is made as a two-piece casting. As shown in FIG. 2, there is provided arcuated shoe plates 11 and 12 which when joined together at the mid-line 13, form the bending shoe of the hand bender 10.

While it is preferred that the hand bender 10 is made from a two-piece casting, it may also be made by any other suitable method. It should be understood that the tool of the present invention may be used for bending tubing, pipe, and other tubular members, but its primary design is more readily adaptable for the bending of convoluted type tubular material. The term "tube" as used herein is intended to include all of the aforementioned types of tubular members.

As shown in FIG. 1, when the arcuated shoe plates 11 and 12 are joined together they form therebetween an internal spacing 14. Positioned within the spacing 14 is one leg 15 of a tubular handle socket 16.

Figure 3:
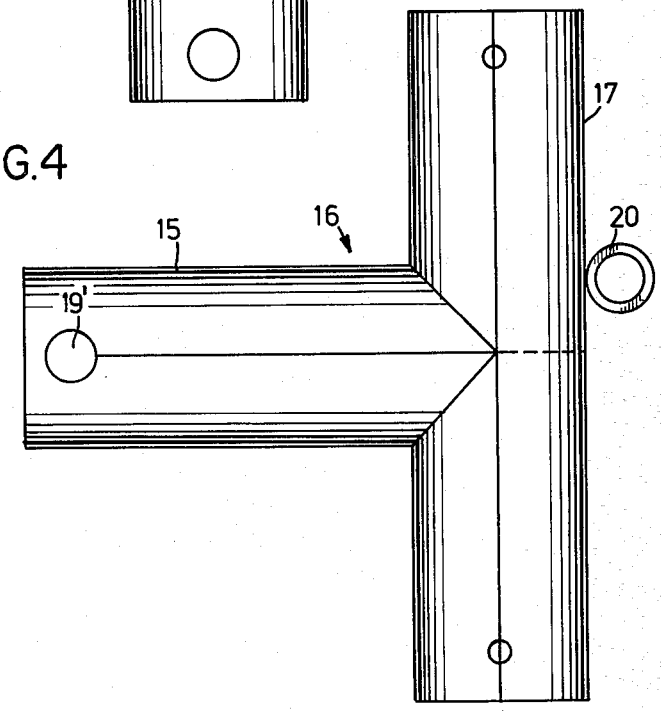
FIG. 3 is a side view of the handle socket of this invention.

In the preferred form, the handle socket is T-shaped, as shown in FIG. 3, and as such provides a handle receiving cross leg 17. By a suitable fastener 18 extending between the shoe plates and through an aperture 19' formed in leg 15 of the handle socket 16, the same is pivotally connected to the arcuated bending shoe of the invention. Either open end of the cross leg 16 may receive an elongated handle 19 in the manner shown in FIG. 1. Mounted on the cross leg 17 offset with respect to a longitudinal mid-line drawn through leg 15 is a hollow bushing 20. This bushing 20 is adapted to receive a connecting stud 21, which passes through reinforced bearing ends 22 of a flexible gripping strap 23, so as to connect the same thereto.

Figure 5:
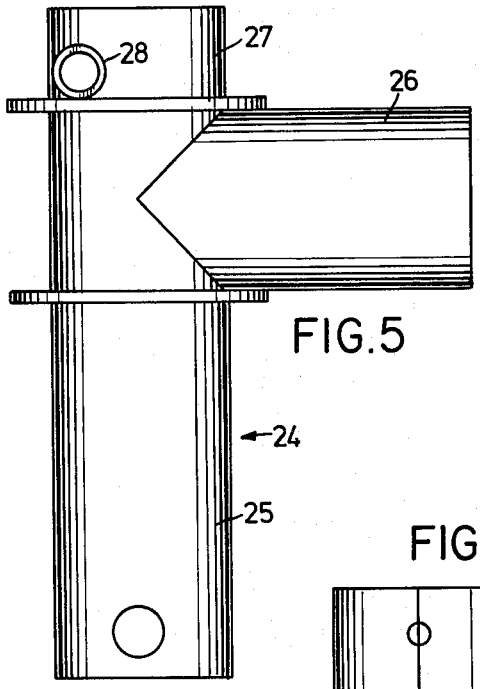
FIG. 5 is the modified form of a handle socket to be employed with this invention.
Figure 4:
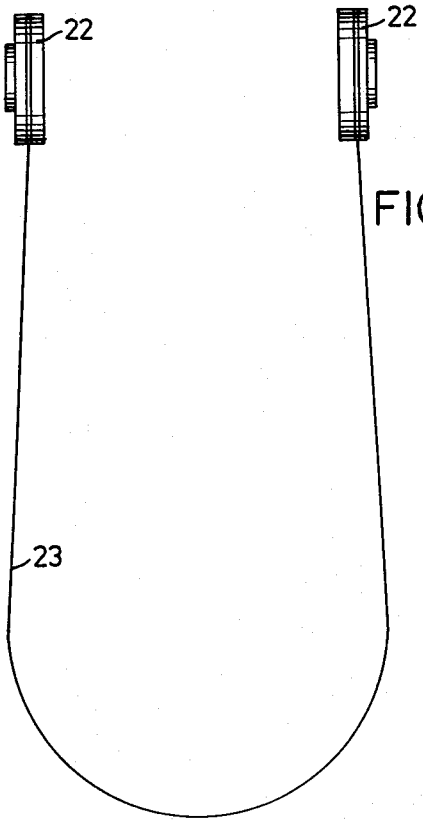
FIG. 4 is a plan view of the tube securing strap as employed in this invention.

In FIG. 5 there is shown a modified handle socket 24 which is generally L-shaped providing right angularly disposed legs 25 and 26, as well as a short hollow extension 27 in axial alignment with one of the legs 25. To either side of the extension 27 are hollow bushings 28 which will receive the studs for attaching the flexible gripping strap 23 thereto.

The arcuated shoe plates 11 and 12, when joined together along the mid-line 13, form a track member 29. The track member 29 has its face grooved in a spur gear like formation so as to provide a series of raised fulcrums 30 formed from the crests of the grooves 31. By forming the track 29 with a series of fulcrums 30, each succeeding fulcrum becomes the point about which the tube bends and through this arrangement, the force required to bend the tube is greatly reduced.

In the event the tube to be bent is convoluted, its convolutions are adapted to be received in the grooves and be contained therein while the tube is being bent over the raised fulcrums 30. By this arrangement, convolutions of different diameters and radii can be readily received onto the track 29 of the bending tool 10, and will be prevented from being collapsed or compressed during the bending operation.

Inwardly of the recess 14 and in spaced relation to either side of the leg 15 of the socket 16, the tool provides arresting pins 32, the purpose and function of which will be hereinafter made apparent.

When a convoluted tube is to be bent, it will have a free end laid tangentially with respect to the arcuated shoe of the bender in the track 29, and projecting through the gripping band 23. As shown in FIG. 1, the initial clockwise movement of the tool 10 through the employment of the handle 19 will cause the handle socket 16 to initially pivot on its connection 18 to the bending shoe, as to bring the strap 23 into contact with the diameter of the tubing to be bent, securing the same in an operative position with respect to the tool 10. As the handle socket 16 engages the pins 32, further clockwise movement of the handle will rock the bending shoe causing the bending of the tube about the fulcrums 30 of the arcuated track 29. During this bending movement, convolutions of the tube will be freely received in the grooves 31 and be wedged against the tapered walls 33 without collapsing or crimping during the bending operation.

In the event that a small diameter tube is to be bent, the strap 23 may be pivoted about its connection to the socket 16 so as to lie adjacent to the opposite end of the shoe. The handle 19 will then be inserted into the opposite end of the cross leg 16 and the foregoing operation will follow, resulting in a like bending of the tube.

It should be noted that in the casting of the arcuated shoes 11 and 12 they may be divided into a right and left hand section to either side of the long axis of the socket leg 15, with one or the other of the sections having a different diameter, and with a track having a different face radius, as well as various pitches to the taper walls 30 of the grooves to accommodate convoluted tubes. This would permit the tool to be used on a variety of different diameter tubes without departing from the specific operation as heretofore described.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described the invention, what I claim as new and desire to secure by Letters Patent is:

1. A tube bending tool comprising, (a) an arcuated bending shoe providing along its peripheral edge a pipe receiving track, (b) means formed on the face of said track providing a series of fulcrums over which a tube is succedingly bent, (c) means providing a handle receiving member connected to said bending shoe along a radius thereof, (d) means connecting said handle receiving member to said shoe at a point along the center radius of said shoe for free limited pivotal movement of said member relative to said shoe, (e) a handle received in said handle receiving member and extending radially beyond the arcuated peripheral edge of said bending shoe, (f) a self adjusting looped tube securing member pivotally connected to said handle receiving member for securing a portion of the tube to be bent in either end of said track as said handle receiving member is initially pivoted relative to said shoe, and (g) means for connecting said tube securing member to said handle receiving member for pivotal movement relative thereto.

2. A tube bending tool as defined by claim 1, wherein said convolution receiving means formed throughout the face of said track comprises a series of grooves, the inner ends of which are formed by converging walls terminating in a curved end, with said grooves freely receiving the convolutions of the tube to be bent so as to prevent the same from collapsing during the tube bending operation.

3. A tube bending tool as defined by claim 1, wherein said tube securing member comprises a flexible looped strap adapted to conform to the diameter and radius of the tube to be bent upon initial pivotal movement of said handle receiving member relative to said bending shoe.

4. A tube bending tool as defined by claim 3, wherein said convolution receiving means formed throughout the face of said track comprises a series of grooves, the inner ends of which are formed by converging walls terminating in a curved end, with said grooves freely receiving the convolutions of the tube to be bent so as to prevent the same from collapsing during the tube bending operation.

5. A tube bending tool as defined by claim 1, wherein said means for freely connecting said tube securing member to said handle receiving member comprises pivot pins freely received in a connecting tube carried by said handle receiving member at a point offset with respect to a longitudinal mid-line extending therethrough and its pivotal point of connection to said bending shoe, with said tube securing member being pivotal so as to lie adjacent to either end of said track.

6. A tube bending tool as defined by claim 5, wherein said convolution receiving means formed throughout the face of said track comprises a series of grooves, the inner ends of which are formed by converging walls terminating in a curved end, with said grooves freely receiving the convolutions of the tube to be bent so as to prevent the same from collapsing during the tube bending operation.

7. A tube bending tool as defined by claim 3, wherein said means for freely connecting said strap to said handle receiving member comprises pivot pins freely received in a connecting tube carried by said handle receiving member at a point offset with respect to a longitudinal mid-line extending therethrough and its pivotal point of connection to said bending shoe, with said tube securing member being pivotal so as to lie adjacent to either end of said track.

* * * * *